US006361337B2

(12) United States Patent
Kurimoto

(10) Patent No.: US 6,361,337 B2
(45) Date of Patent: Mar. 26, 2002

(54) LEVER-TYPE CONNECTOR

(75) Inventor: Naoya Kurimoto, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 09/796,644

(22) Filed: Mar. 2, 2001

(30) Foreign Application Priority Data

Mar. 3, 2000 (JP) ..... 12-058643

(51) Int. Cl.[7] ..... H01R 13/62
(52) U.S. Cl. ..... 439/157
(58) Field of Search ..... 439/157, 372, 439/160, 155, 354

(56) References Cited

U.S. PATENT DOCUMENTS 5,443,393 A * 8/1995 Okumura et al. ..... 439/157
5,499,926 A 3/1996 Akeda ..... 439/157
6,120,308 A * 9/2000 Hayashi ..... 439/157

* cited by examiner

*Primary Examiner*—Brian Sircus
*Assistant Examiner*—Phuong K T Dinh
(74) *Attorney, Agent, or Firm*—Banner & Witcoff, Ltd.

(57) ABSTRACT

The invention stabilizes the fitting state of a long and thin multipolar lever-type connector. A female housing 20, of a pair of long and narrow housings 10 and 20, has a pivotable lever 23 attached thereto. The lever 23 is provided with cam grooves 27 into which follower pins 13 of the male housing 10 are inserted. The lever 23 is pivoted while these follower pins 13 are in a joined state therewith, thereby causing the two housings 10 and 20 to fit together. Both ends of the female housing 20, relative to the lengthwise direction thereof, are provided with housing members 30 that house coiled springs 40 and sliders 41 having locking arms 44. The locking arms 44 are provided with locking protrusions 47 that engage with locking members 14 of the male housing 10 when the housings 10 and 20 reach the correct fitting state. Tapered faces 15 and 48 are formed on locking portions of the locking members 14 and the locking protrusions 47 respectively.

21 Claims, 5 Drawing Sheets

LEVER-TYPE CONNECTOR

TECHNICAL FIELD

The present invention relates to a lever-type electrical connector.

BACKGROUND TO THE INVENTION

Conventionally, when a connector, such as a multipolar connector, requires a high fitting force, a lever-type connector is employed. In this lever-type connector, a cam groove is provided in a lever attached to a male housing. The lever is pivoted while a follower pin attached to a female housing is in an inserted state within the cam groove, the follower pin thereby being moved along the cam groove and the two housings being drawn together. The two housings reach a fully fitted state when the lever reaches a final position, and the lever is retained by a stopping member provided on the male housing, the two housings thereby being maintained in a latched state.

An example of this type of connector is described in JP-6-333637.

In this type of multipolar connector, both housings have a long narrow shape and extend in a direction parallel to cavities within these housings. In addition, the follower pin that is fitted within the cam groove of the lever is provided at an approximately central location relative to the lengthwise direction of the two housings. As a result, when the two housings are in the fitted state, movement in an anterior-posterior direction can readily occur between both lengthwise ends of the two housings (with the follower pin being located in the centre). Consequently, the two housings are unstable even though they are in a fitted state.

It was considered that this problem might be solved by providing retaining devices so as to retain both lengthwise ends of the two housings. However, it is extremely time consuming, when releasing the fitting state of the two housings, to release not only the lever from the stopping member, but also to release the retained state of the retaining devices at two different locations.

The present invention has taken the above problem into consideration, and aims to present a multipolar lever-type connector that has a stable fitting state and that can be easily released from this fitting state.

SUMMARY OF THE INVENTION

According to the invention there is provided a lever-type connector having two relatively long and thin housings for mutual engagement, one of the housings having cam pins provided thereon, and the other connector housing a corresponding lever for engagement with said cam pins, and operable to draw together and to separate said housings characterized in that mutually engageable and releasable retaining devices are provided at the ends of lengths of said housings, said retaining devices being provided partially on each housing and being resiliently engageable and disengageable by application of a predetermined force to said lever.

Such a connector provides a releasable semi-latch at the extremities of the long dimension, and accordingly prevents rocking motion about the pivot axis defined by said cam pins.

In a preferred embodiment these latches are provided on respective spring biased sliders which retreat as the housings are drawn together. Such sliders are released at the point of full engagement to permit latching engagement of the retaining devices. This embodiment provides detection of correct fitting whereby a failure to move the lever to the final condition corresponding to full engagement of the housings, causes the housings to be moved apart.

BRIEF DESCRIPTION OF DRAWINGS

Other features of the invention will be apparent from the following description of a preferred embodiment shown by way of example only in the accompanying drawings in which.

DESCRIPTION OF PREFERRED EMBODIMENT

Figure 1:
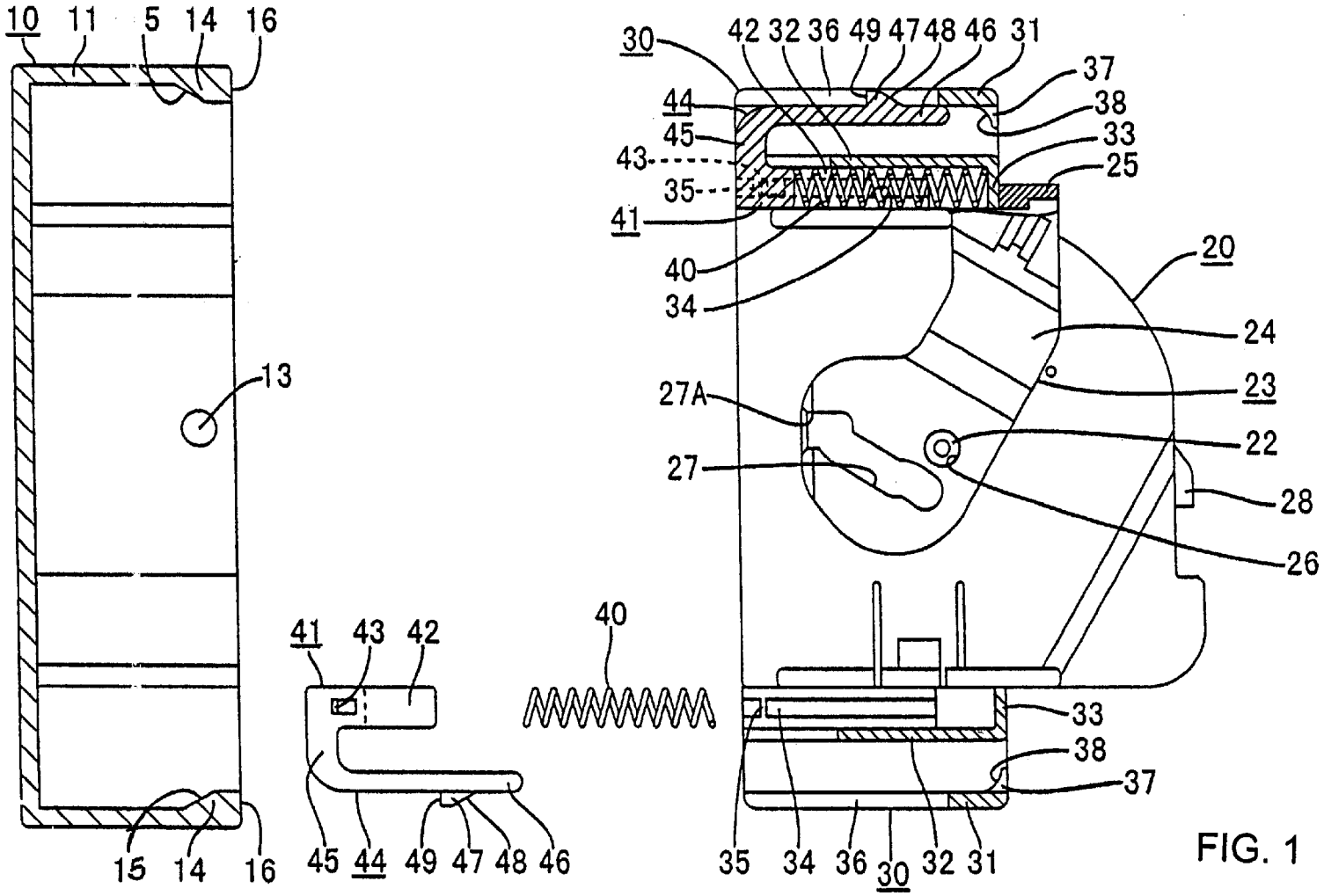
FIG. 1 is a partially cut-away plan view of a connector of an embodiment of the present invention.

An embodiment of the present invention is described below with the aid of FIGS. 1 to 10. As shown in FIG. 1, the connector of this embodiment is provided with a male connector housing 10 that fits with a female connector housing 20, a lever 23 being attached to this female housing 20. The fitting face sides of the male and female housings 10 and 20 will hereafter be considered as the anterior sides.

Figure 2:
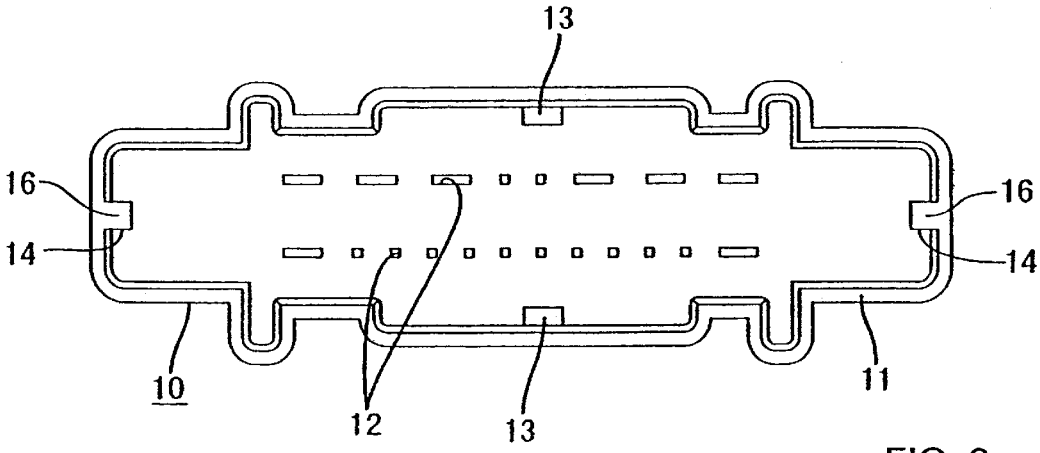
FIG. 2 is a front view of a male housing.

The male housing 10 has a long and narrow shape and is provided with a cylindrical hood 11 that is open to the anterior. As shown in FIG. 2, a plurality of cavities 12 are aligned in two layers within the male housing 10 along the lengthwise direction thereof. Each cavity 12 can have a male terminal fitting (not shown) attached therein. A pair of follower pins 13 protrude from inner faces of the hood 11 at an approximately central location relative to the lengthwise direction of the male housing 10, these follower pins 13 facing one another. The follower pins 13 can be inserted into cam grooves 27 of a lever 23 of the female housing 20 (to be described).

Figure 3:
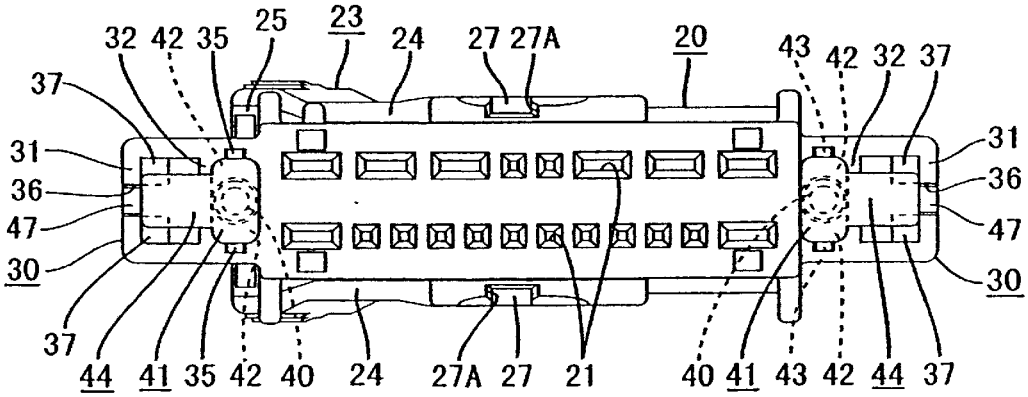
FIG. 3 is a front view of a female housing.

As shown in FIGS. 1 and 3, the female housing 20 can be fitted into the hood 11 of the male housing 10 and, like the male housing 10, is long and narrow in shape. A plurality of cavities 21 are aligned within the female housing 20, the location of these cavities 21 corresponding to the location of the cavities 12 of the male housing 10. Female terminal fittings are housed within the cavities 21, these female terminal fittings fitting with the male terminal fittings.

A pair of axle pins 22, to which the lever 23 is attached, protrude from outer faces of the female housing 20. The lever 23 has an inverted-U shape and is formed from a pair of arms 24 joined by a bridge member 25. The lever 23 is pivotably attached to the female housing 20 by positioning the two arms 24 so as to grip the female housing 20 and fitting the axle pins 22 into attachment holes 26 formed in the two arms 24. The lever 23 can be rotated along the lengthwise direction of the female housing 20 by pressing the bridge member 25, with the axle pins 22 serving as the pivot centre.

Figure 4:
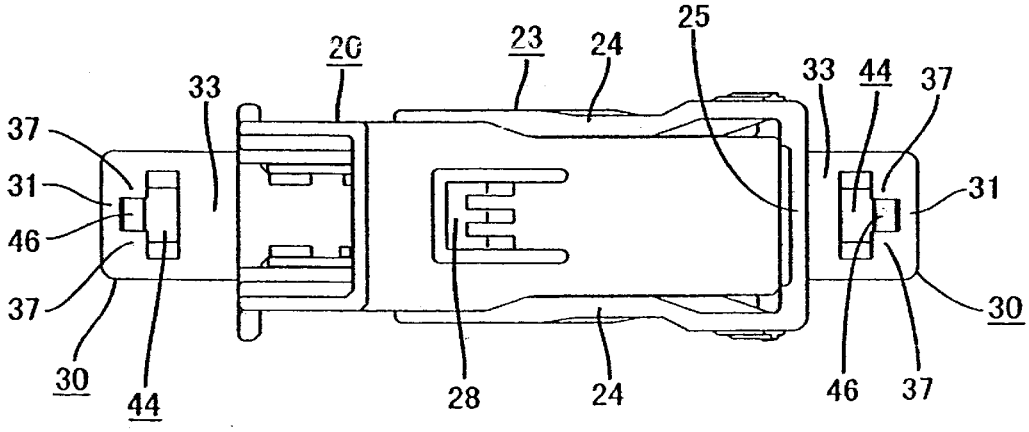
FIG. 4 is a rear face view of the female housing.
Figure 6:
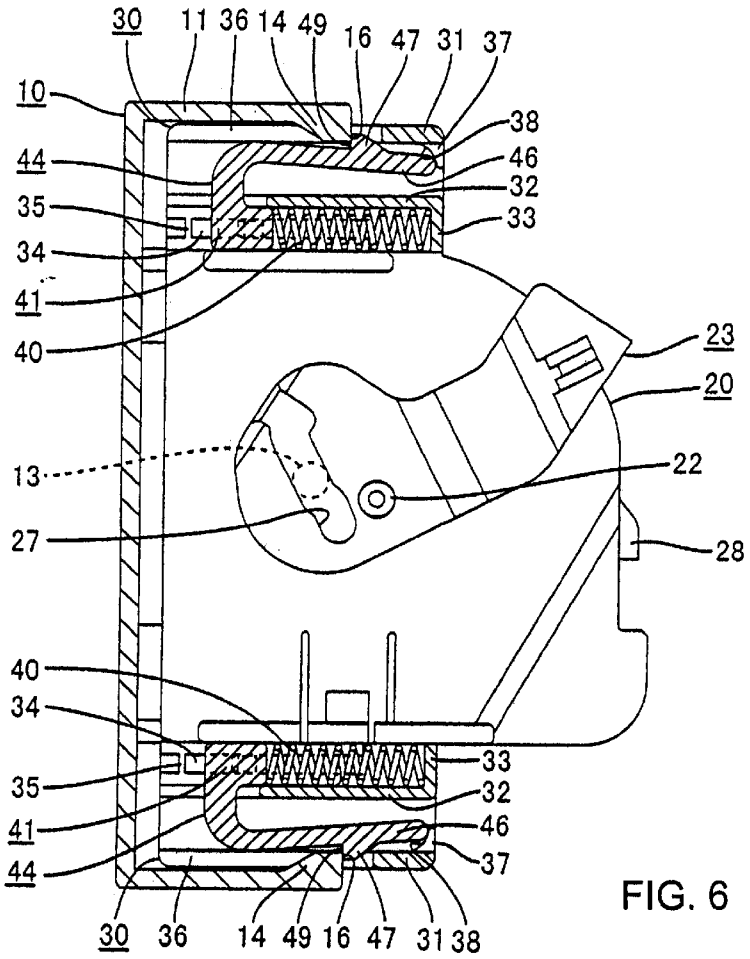
FIG. 6 is a partially cut-away plan view showing the two housings being fitted together.
Figure 5:
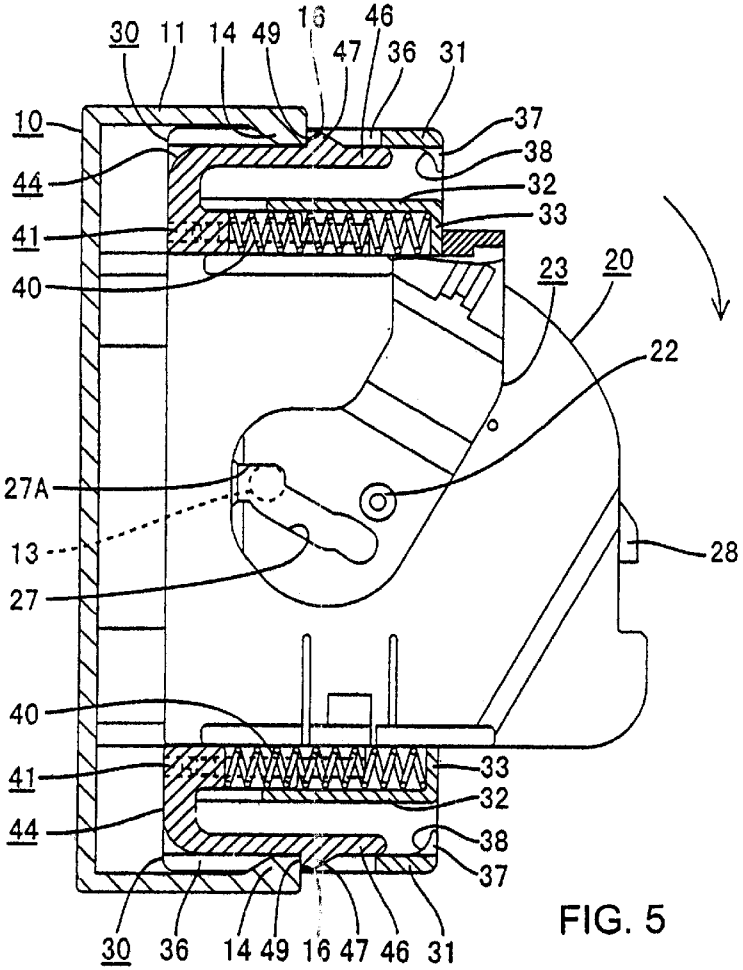
FIG. 5 is a partially cut-away plan view showing the two housings in an early stage of being fitted together.

The cam grooves 27, into which the follower pins 13 of the male housing 10 are inserted, are formed in the arms 24. As shown in FIG. 1, when the lever 23 is in a state prior to being pivoted, an entrance opening 27A of each cam groove 27 faces the anterior. As shown in FIG. 5, pivoting the lever 23 after the follower pins 13 have been inserted into the openings 27A causes the follower pins 13 to move along the cam grooves 27 and causes the two housings 10 and 20 to fit together. The two housings 10 and 20 reach the correct fitting position when the lever 23 has been rotated to the position shown in FIG. 8. When the lever 23 has been rotated to the position shown in FIG. 8, an end of the bridge member 25 thereof is retained by a stopping member 28 provided on the female housing 20. As shown in FIG. 4, the stopping member 28 has a cantilevered shape and is capable of bending resiliently into the female housing 20.

As shown in FIG. 1, a pair of housing members 30 protrude from both lengthwise ends of the female housing 20. These housing members 30 have an approximately angular cylindrical shape that is open to the anterior. Sliders 41 provided with coiled springs 40 and locking arms 44 are housed within these housing members 30, the coiled springs 40 being inserted first from the anterior via the opening portions thereof, and then the sliders 41 being inserted therein. The sliders 41 that have been attached to the housing members 30 are capable of moving in an anterior-posterior direction within these housing members 30 along the fitting direction of the two housings 10 and 20.

As shown in FIGS. 1 and 3, outer edges of a pair of side walls (these side walls protrude along the lengthwise direction of the female housing 20) of the housing members 30 are joined with outer walls 31. The housing members 30 are divided by inner walls 32. Spaces between the inner sides of the inner walls 32 house the coiled springs 40, and spring force receiving walls 33 are provided at the posterior ends of the inner walls 32. Posterior ends of the coiled springs 40 are restrained by these spring receiving walls 33, and when the sliders 41 are moved to the posterior, the coiled springs 40 are compressed and the spring force thereof accumulates. When the sliders 41 are attached in the position shown at the top of FIG. 1, the coiled springs 40 are slightly compressed, and this results in the sliders 41 being kept positioned towards the anterior.

As shown in FIG. 3, the coiled springs 40 make contact with the centre (relative to the widthwise direction thereof) of the sliders 41. Forked holders 42, these maintaining the centrally located coiled springs 40 in a gripped state, are located at both edges relative to the widthwise direction of the sliders 41 and extend towards the posterior. A pair of protrusions 43 are formed on both side faces of the sliders 41. These protrusions 43 enter a pair of guiding grooves 34 formed in inner faces of the housing members 30 and slide along these guiding grooves 34, thereby guiding the movement of the sliders 41 in the anterior-posterior direction. Stoppers 35 are formed at anterior ends of the guiding grooves 34. The protrusions 43 engage with these stoppers 35, thereby retaining the sliders 41 in the anterior direction. When the sliders 41 are in the position shown at the top of FIG. 1, the protrusions 43 are in an engaged state with the stoppers 35.

As shown in FIG. 1, cantilever shaped locking arms 44 protrude outwards from anterior end portions of side faces of the sliders 41, these side faces extending along the inner walls 32 of the housing members 30. Anterior portions of the inner walls 32 are cut away so as to allow the locking arms 44 to enter therein. The locking arms 44, which are provided with base members 45 and arms 46 that extend towards the posterior, can be bent along the lengthwise direction of the female housing 20 with the base members 45 serving as the bending regions. The arms 46 extend along the outer walls 31 of the housing members 30. Bending the locking arms 44 causes the arms 46 to move inwards or outwards (see FIG. 6).

Figure 8:
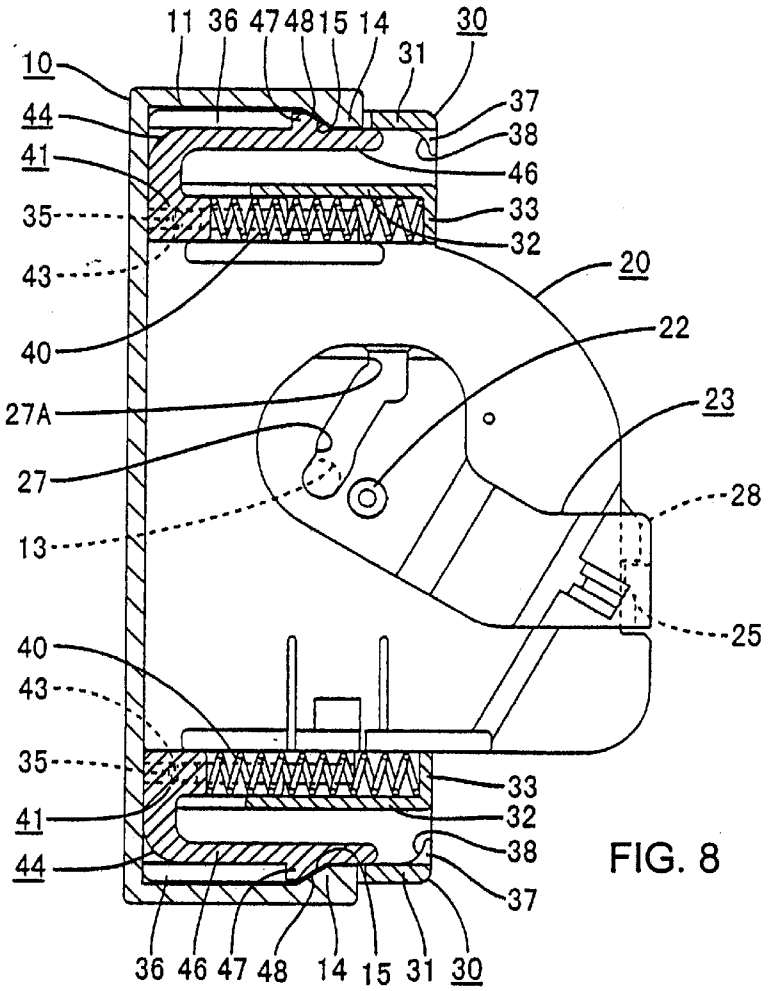
FIG. 8 is a partially cut-away plan view showing the two housings correctly fitted together.

The side faces of the arms 46 that extend along the outer walls 31 of the housing members 30 are provided with outwardly protruding locking protrusions 47. These locking protrusions 47 are located posteriorly with respect to the centre (relative to the lengthwise direction thereof) of the arms 46. Recessed grooves 36, into which the locking protrusions 47 enter, are formed in the outer walls 31 of the housing members 30. These recessed grooves 36 are provided along a specified distance from the anterior ends of the outer walls 31 and are open at the anterior. As shown in FIGS. 1 and 2, locking members 14 protrude inwards at the anterior end of the hood 11 of the male housing 10. The locking protrusions 47 of the locking arms 44 engage with these locking members 14. A tapered face 15 is formed on a posterior end face of each locking member 14, this tapered face 15 joining with the inner face of the hood 11 and being gently inclined. A tapered face 48 is provided on a posterior face of each locking protrusion 47 and is inclined at the same angle as the tapered faces 15. These tapered faces 15 and 48 mutually engage. As shown in FIG. 8, if a pulling force exceeding a specified degree is exerted on the mutually engaged locking arms 44 and locking members 14 so as to move the two housings 10 and 20 in a direction of separation, the locking arms 44 bend while being guided by the tapered faces 15 and 48, and the engaged state of the locking members 14 is released. That is, the tapered faces 15 and 48 form a semi-locking configuration.

As shown in FIG. 5, while the two housings 10 and 20 are being fitted together, the locking members 14 of the male housing 10 enter the recessed grooves 36 in the outer walls 31 of the housing members 30, and strike against anterior faces of the locking protrusions 47. When the locking members 14 are in an inserted state within the recessed grooves 36, inner faces of these locking members 14 form approximately unified faces with inner faces of the outer walls 31 of the housing members 30. Anterior faces of the locking members 14 are at right angles to the fitting direction of the two housings 10 and 20, these faces forming pushing members 16 that correspond to the locking protrusions 47. The anterior faces of the locking protrusions 47, like the pushing members 16, are at right angles to the fitting direction of the two housings 10 and 20. These anterior faces form pushing receiving members 49 that receive the pushing force from the pushing members 16. Performing the fitting operation of the two housings 10 and 20 while the pushing members 16 make contact with the pushing receiving members 49 causes an increased pushing force to be exerted on the pushing receiving members 49, thereby pushing the sliders 41 to the posterior and compressing the coiled springs 40.

As shown in FIGS. 1 and 3, a pair of movable guiding members 37 is provided at the posterior end of side walls of each housing member 30. These movable guiding members 37 adjoin the outer walls 31 at the side faces of the housing members 30 and protrude to a location where they form approximately unified faces with edges of the recessed grooves 36. As shown in FIG. 1, anterior faces of the movable guiding members 37 form arc-shaped faces 38. Posterior end portions of the arms 46 of the locking arms 36 engage with these arc-shaped faces 38. When the sliders 41 are moved towards the posterior while the posterior end portions of the arms 46 are engaged with the arc-shaped faces 38, the locking arms 44 bend inwards as they are guided by the arc-shaped faces 38. The posterior end portions of the arms 46 of the locking arms 44 are rounded so as to be semicircular in shape.

The present embodiment is configured as described above. Next, the operation thereof will be explained. Firstly, as shown in FIG. 5, the female housing 20 is inserted into the hood 11 of the male housing 10, the follower pins 13 fitting loosely within the entrance holes 27A of the cam grooves 27 of the lever 23. At this juncture, the pushing members 16 of the male housing 10 make contact with the pushing receiving members 49 of the locking protrusions 47. The lever 23 is then pivoted in the direction shown by the arrow.

While the lever 23 is being pivoted, the follower pins 13 move inwards along the cam grooves 27 and the two housings 10 and 20 are brought closer together in the fitting direction. The pushing receiving members 49 receive a greater pushing force from the pushing members 16 while the fitting of the two housings 10 and 20 progresses, this pushing force pushing the sliders 41 towards the posterior and compressing the coiled springs 40. While the lever 23 is pivoted further from the state where the posterior end portions of the arms 46 of the locking arms 44 make contact with the arc-shaped faces 38 of the movable guiding members 37, the sliders 41 move further towards the posterior, the posterior end portions of the arms 46 being guided by the arc-shaped faces 38 of the movable guiding members 37 and the locking arms 44 bending inwards. As the locking arms 44 bend, the arms 46 provided with the locking protrusions 47 bend inwards, thereby causing the engagement of the pushing receiving members 49 with the pushing members 16 to gradually decrease.

If the pivoting of the lever 23 is halted while the two housings 10 and 20 are partly fitted together, the accumulated spring force of the coiled springs 40 is released, thereby separating the two housings 10 and 20. It can be ascertained by this means that the two housings 10 and 20 were partly fitted together. The coiled springs 40 are provided at both lengthwise ends of the two housings 10 and 20. Consequently, the partly fitted housings 10 and 20 separate smoothly from one another.

Figure 7:
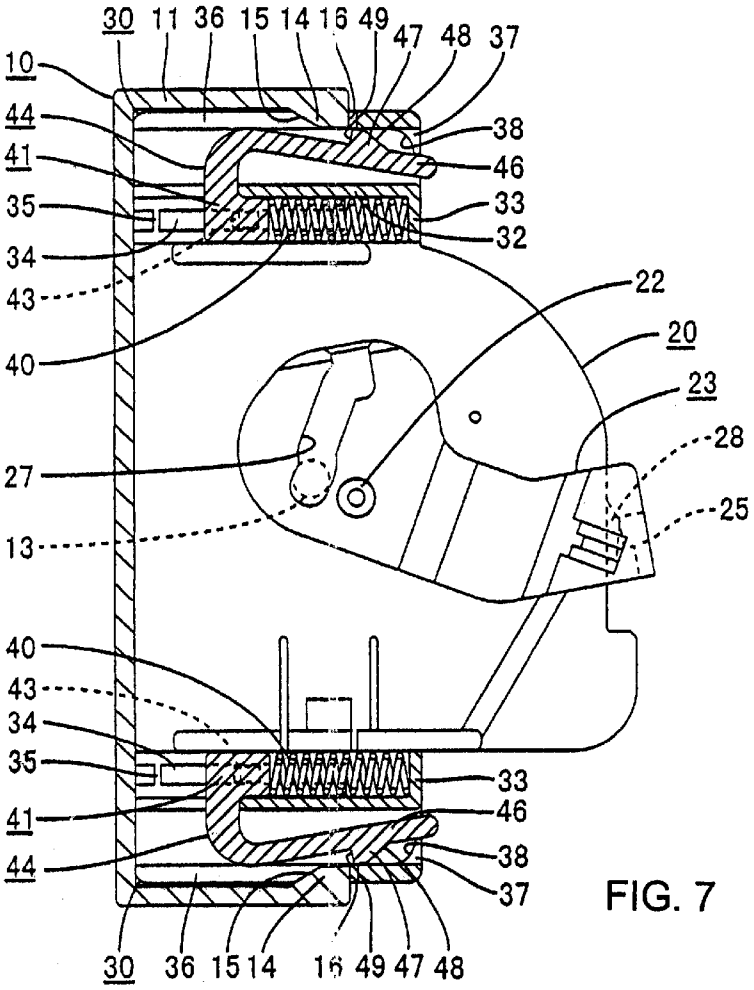
FIG. 7 is a partially cut-away plan view showing the two housings immediately prior to reaching the correct fitting position.
Figure 10:
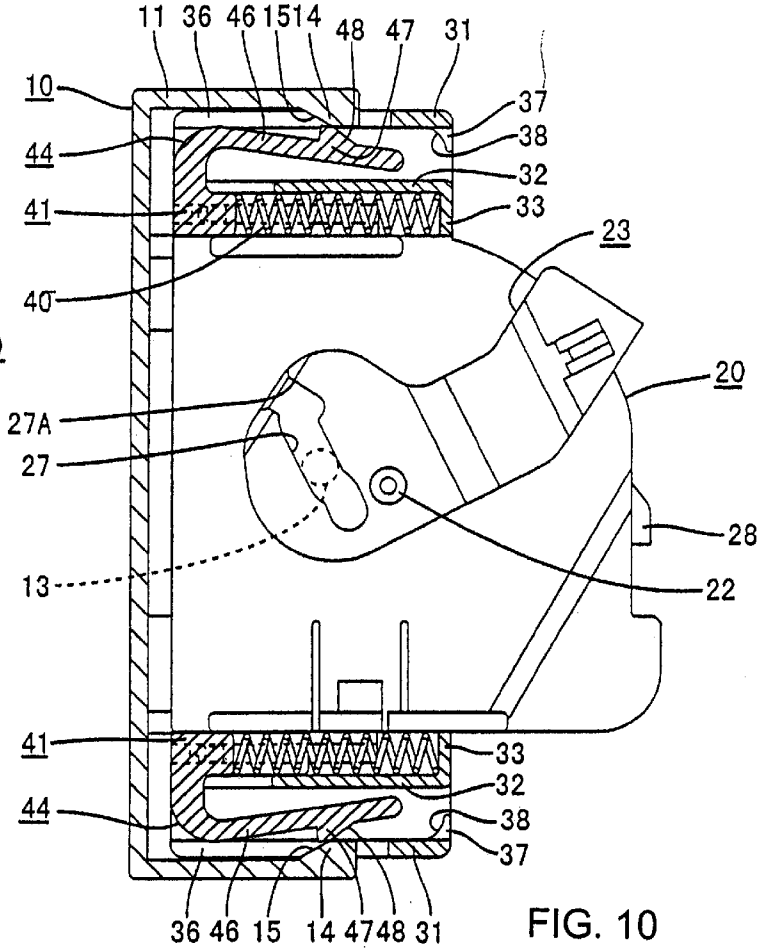
FIG. 10 is a partially cut-away plan view showing the two housings being separated.
Figure 9:
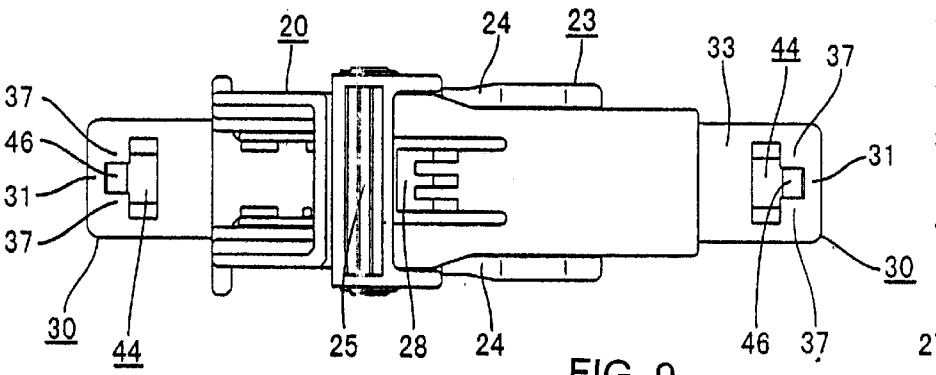
FIG. 9 is a rear face view showing the two housings correctly fitted together.

When the sliders 41 reach the position shown in FIG. 7, the locking arms 44 are bent to a position whereby the pushing receiving members 49 are completely released from being pushed by the pushing members 16. At this juncture, the posterior end portions of the arms 46 are no longer guided by the arc-shaped faces 38 of the movable guiding members 37, inner edges of the movable guiding members 37 face the outer faces of the arms 46, and the posterior end portions of the arms 46 protrude out from the posterior of the housing members 30.

The spring force of the compressed coiled springs 40 is released while the pushing state of pushing members 16 and the pushing receiving members 49 is released, pushing the sliders 41 to the anterior. This forward movement of the sliders 41 is guided by the protrusions 43 sliding within the guiding grooves 34. While the sliders 41 are moving to the anterior, the locking arms 44, while remaining in a bent state, move so as to pass under the locking members 14 of the male housing 10. Then, as shown in FIG. 8, the sliders 41 return to their original position and the locking arms 44 return to their original position, the tapered faces 48 of the locking protrusions 47 being retained by the tapered faces 15 of the locking members 14. At this juncture, the protrusions 43 of the sliders 41 engage with the stoppers 35, thereby preventing the sliders 41 from moving any further towards the anterior. Furthermore, the coiled springs 40 have regained their original length (their length prior to fitting), thereby avoiding set-in fatigue.

At approximately the same time, the bridge member 25 of the lever 23 causes the stopping member 28 to bend resiliently, and the bridge member 25 rises over it (see FIG. 7). When the lever 23 is pivoted to the position shown in FIG. 8, it is retained by the stopping member 28 which has returned to the end of the bridge member 25 (see FIG. 9). By this means, the lever 23 is maintained in a locked state. At this juncture, the two housings 10 and 20 are at the correct fitting depth (see FIG. 8). The lever 23 is retained by the stopping member 28 while the follower pins 13 are in a fitting state within the cam grooves 27, and the locking arms 44 provided at both lengthwise ends of the two housings 10 and 20 are retained by the locking members 14, this maintaining the two housings 10 and 20 in a correct fitting state. In this manner, both lengthwise ends of the two housings 10 and 20 are maintained and, while the two housings 10 and 20 are in the fitted state, instability and slippage to the anterior or posterior, relative to the lengthwise direction thereof, is prevented.

If the two housings 10 and 20 are to be separated for maintenance or the like, the bridge member 25 of the lever 23 is released from its retained state while the stopping member 28 is bent, then the lever 23 is rotated in the opposite direction to which it was first rotated. While the lever 23 is being rotated, the follower pins 13 move along the cam grooves 27 to the entrance openings 27A and the two housings 10 and 20 are moved in a direction of separation. At this juncture, the locking arms 44 are guided inwards from their retained state with the locking members 14 as the pulling force increases, being guided by the tapered faces 15 and 48 that fit mutually together, and as they bend these locking arms 44 are released from their retained state with the locking members 14 (see FIG. 10). By this means, the two housings 10 and 20 are released from the retained state and can be separated by rotating the lever 23 further. The locking arms 44 and the locking members 14 form the semi-locking configuration, and consequently their retained state is released automatically by rotating the lever 23.

In the embodiment described above, both lengthwise ends of the two housings 10 and 20 are provided with locking arms 44 and locking members 14 that are retained by the tapered faces 15 and 48. Consequently, the fitting state of the two housings 10 and 20 that have been fitted together is stable, and the two housings 10 and 20 can easily be released from this fitting state.

This lever-type connector is provided with a fitting detecting means composed of the coiled springs 40 and the sliders 41. Consequently, the fitting state of the two housings 10 and 20 can be ascertained irrespective of the position of the lever 23. Furthermore, the locking arms 44 (these comprising the retaining device) are provided at both ends of the two housings 10 and 20 in a unified manner with the sliders 41. Consequently, the retaining device and the fitting detecting means can be formed in a unified manner, thereby allowing the configuration to be simpler than in the case where the two are provided separately.

The present invention is not limited to the embodiments described above with the aid of figures. For example, the possibilities described below also lie within the technical range of the present invention. In addition, the present invention may be embodied in various other ways without deviating from the scope thereof.

(1) In the embodiment described above, the locking arms and the locking members are both provided with tapered faces. However, the tapered faces may be omitted on one of these two.

(2) In the embodiment described above, the locking arms that comprise the retaining device are provided in the sliders that comprise the fitting detecting means. However, in the case where fitting detecting is not required, the coiled springs, the sliders and the housing members can be omitted and the locking arms can be provided on side faces of the female housing.

What is claimed is:

1. A lever-type connector having two relatively long and thin housings for mutual engagement, one of the housings having cam pins provided thereon, and the other connector housing having a corresponding lever for engagement with said cam pins, and operable to draw together and to separate said housings upon rotation of the lever by the user applying a force directly to the lever, wherein mutually engageable and releasable retaining devices are provided at the ends of lengths of said housings, said retaining devices being provided partially on each housing and being resiliently engageable and disengageable by manual operation of said lever, and said retaining devices retaining the two housings in engagement when the housings are in a fully fitted condition wherein one of the retaining devices comprises a resilient arm which extends in a direction opposite the mating direction of the two housings.

2. A connector according to claim 1 wherein said devices each comprise an abutment on one of said housings and a resilient cantilevered arm on the other of said housings, said arms each having a protrusion engageable with said abutment.

3. A connector according to claim 2 wherein said abutment and protrusion have mutually engageable tapered faces.

4. A connector according to claim 2 wherein said arms are provided on a respective slider movable against a resilient force and against the direction of engagement of said housings.

5. A connector according to claim 3 wherein said arms are provided on a respective slider movable against a resilient force and against the direction of engagement of said housings.

6. A connector according to claim 4 wherein said slider is movable by direct contact with said one housing.

7. A connector according to claim 5 wherein said slider is movable by direct contact with said one housing.

8. A connector according to claim 4 wherein said slider is movable by direct contact of said protrusions with said one housing.

9. A connector according to claim 6 wherein said slider is movable by direct contact of said protrusions with said one housing.

10. A connector according to claim 4 wherein said arms are bendable by projections of said other housing on movement of said slider against said resilient force.

11. A connector according to claim 6 wherein said arms are bendable by projections of said other housing on movement of said slider against said resilient force.

12. A connector according to claim 8 wherein said arms are bendable by projections of said other housing on movement of said slider against said resilient force.

13. A connector according to claim 10 wherein the tips of said arms contact said projections for bending thereof.

14. A connector according to claim 11 wherein the tips of said arms contact said projections for bending thereof.

15. A connector according to claim 12 wherein the tips of said arms contact said projections for bending thereof.

16. A connector according to claim 4 wherein said resilient force is provided by coil springs associated one each with said sliders and operable between said sliders and said other housing.

17. A connector according to claim 6 wherein said resilient force is provided by coil springs associated one each with said sliders and operable between said sliders and said other housing.

18. A connector according to claim 8 wherein said resilient force is provided by coil springs associated one each with said sliders and operable between said sliders and said other housing.

19. A connector according to claim 16 wherein said sliders are biased outwardly of said other housing to a stop provided on said other housing.

20. A connector according to claim 1 wherein said cam pins are provided substantially at the mid-point of the length of said one of said housings.

21. A lever-type connector having two relatively long and thin housings for mutual engagement, one of the housings having cam pins provided thereon, and the other connector housing having a corresponding lever for engagement with said cam pins, and operable to draw together and to separate said housings, wherein mutually engageable and releasable retaining devices are provided at the ends of lengths of said housings, said retaining devices being provided partially on each housing and being resiliently engageable and disengageable by application of a predetermined force to said lever, wherein said devices each comprise an abutment on one of said housings and a resilient cantilevered arm on the other of said housings, said arms each have a protrusion engageable with said abutment, and said arms are provided on a respective slider movable against a resilient force and against the direction of engagement of said housings.

* * * * *